US006488336B1

(12) United States Patent
Wang

(10) Patent No.: US 6,488,336 B1
(45) Date of Patent: Dec. 3, 2002

(54) BACKREST ADJUSTMENT DEVICE

(75) Inventor: Bing-Nan Wang, Jia Yi Hsien (TW)

(73) Assignee: Tung Yu Oa Co., Ltd., Jia Yi Hsien (TW)

( * ) Notice: Subject to any disclaimer, the term of this patent is extended or adjusted under 35 U.S.C. 154(b) by 0 days.

(21) Appl. No.: 09/962,032

(22) Filed: Sep. 25, 2001

(51) Int. Cl.[7] ..... A47C 7/60

(52) U.S. Cl. ..... 297/301.7; 297/300.8; 297/302.7

(58) Field of Search ..... 297/301.1, 301.4, 297/301.5, 301.6, 301.7, 302.1, 302.5, 302.4, 302.6, 302.7, 300.8

(56) References Cited

U.S. PATENT DOCUMENTS 5,046,780 A * 9/1991 Decker et al. ..... 297/300.1
5,121,934 A * 6/1992 Decker et al. ..... 297/300.1
5,685,607 A * 11/1997 Hirschmann ..... 297/300.8
5,762,399 A * 6/1998 Liu ..... 297/300.8
6,174,031 B1 * 1/2001 Lindgren et al. ..... 297/300.8
6,419,320 B1 * 7/2002 Wang ..... 297/344.19

* cited by examiner

*Primary Examiner*—Anthony D. Barfield
*Assistant Examiner*—Erika Garrett
(74) *Attorney, Agent, or Firm*—Alan D. Kamrath; Rider, Bennett, Egan & Arundel

(57) ABSTRACT

A backrest adjustment device has a hollow base seat, an oblong panel, a guide mount, a slide seat, a nut, a coiled spring, a compression spring, a positioning plate, a top panel, a screw rod, and a control rod. The positioning plate has a threaded aperture. The guide mount is disposed on the oblong panel. The guide mount has a bottom recess and an oblong hole. The positioning plate is inserted in the bottom recess of the oblong panel. The slide seat has a bottom groove, a slant slot, and a lateral lug. The screw rod has a disk head. The top panel has a plurality of click serrations. The top panel engages with the hollow base seat. The control rod has an oval plate, an extension bar, and a plurality of annular grooves. The screw rod passes through the compression spring, the lateral lug, the coiled spring, the nut, and the oval plate. The extension bar is disposed between the top panel and the hollow base seat.

3 Claims, 5 Drawing Sheets

BACKREST ADJUSTMENT DEVICE

BACKGROUND OF THE INVENTION

The present invention relates to a backrest adjustment device. More particularly, the present invention relates to a backrest adjustment device which adjusts a backrest of a chair easily.

A conventional backrest adjustment device has a complex structure. It is difficult for a user to operate the conventional backrest adjustment device.

SUMMARY OF THE INVENTION

An object of the present invention is to provide a backrest adjustment device which adjusts an angle of a backrest of a chair easily.

Accordingly, a backrest adjustment device comprises a hollow base seat, an oblong panel, a guide mount, a slide seat, a nut, a coiled spring, a compression spring, a positioning plate, a top panel, a screw rod, and a control rod. The positioning plate has a threaded aperture. The oblong panel has a threaded hole. The guide mount is disposed on the oblong panel. The guide mount has a bottom recess and an oblong hole. The positioning plate is inserted in the bottom recess of the oblong panel. The slide seat has a bottom groove, a slant slot, and a lateral lug. The screw rod has a disk head. The top panel has a plurality of click serrations. The top panel engages with the hollow base seat. The control rod has an oval plate, an extension bar, and a plurality of annular grooves. The screw rod passes through the compression spring, the lateral lug, the coiled spring, the nut, and the oval plate. The extension bar is disposed between the top panel and the hollow base seat. A screw passes through the slot of the slide seat, the oblong hole of the guide mount, and the threaded aperture of the positioning plate.

DETAILED DESCRIPTION OF THE INVENTION

Figure 1:
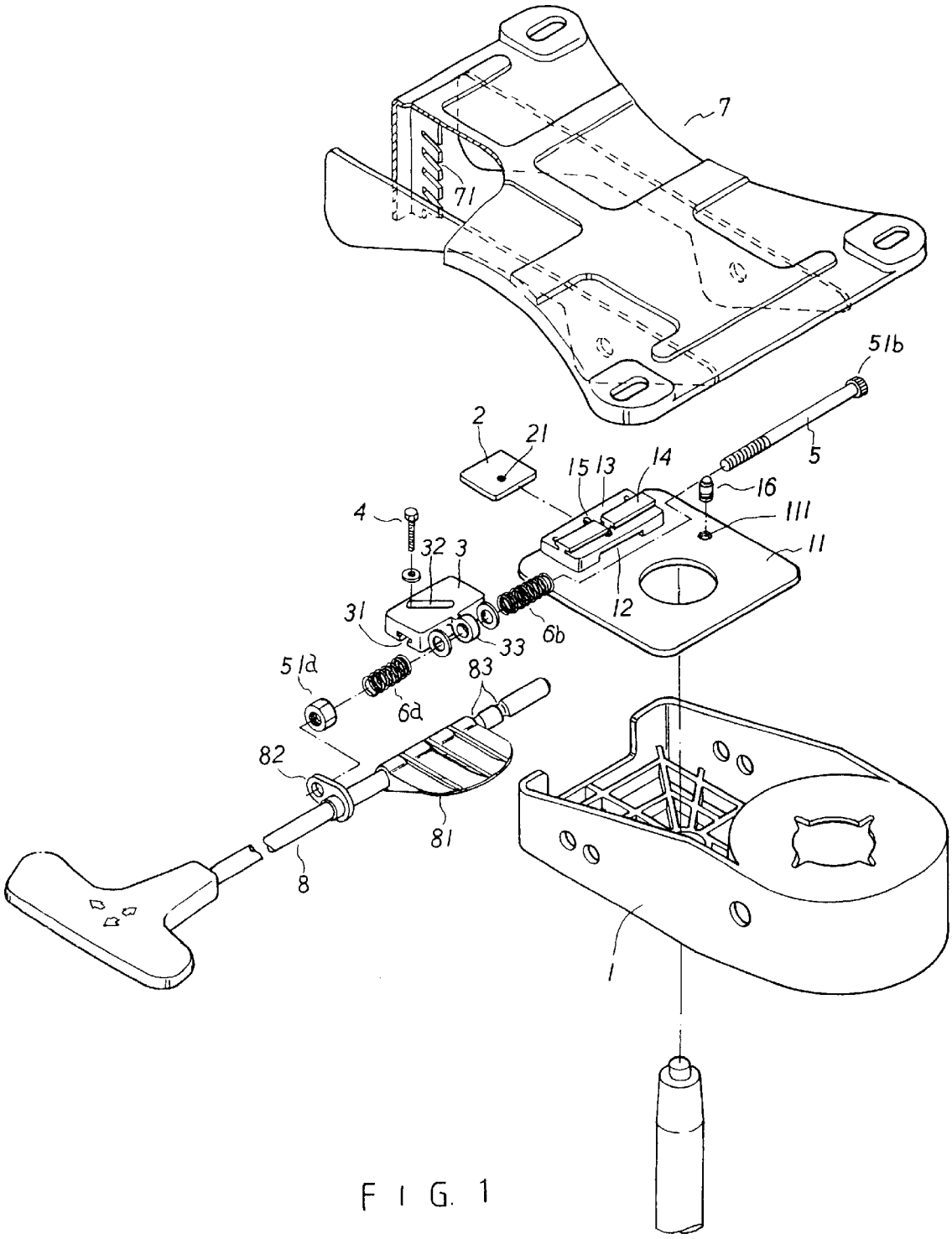
FIG. 1 is a perspective exploded view of a backrest adjustment device of a preferred embodiment in accordance with the present invention.
Figure 2:
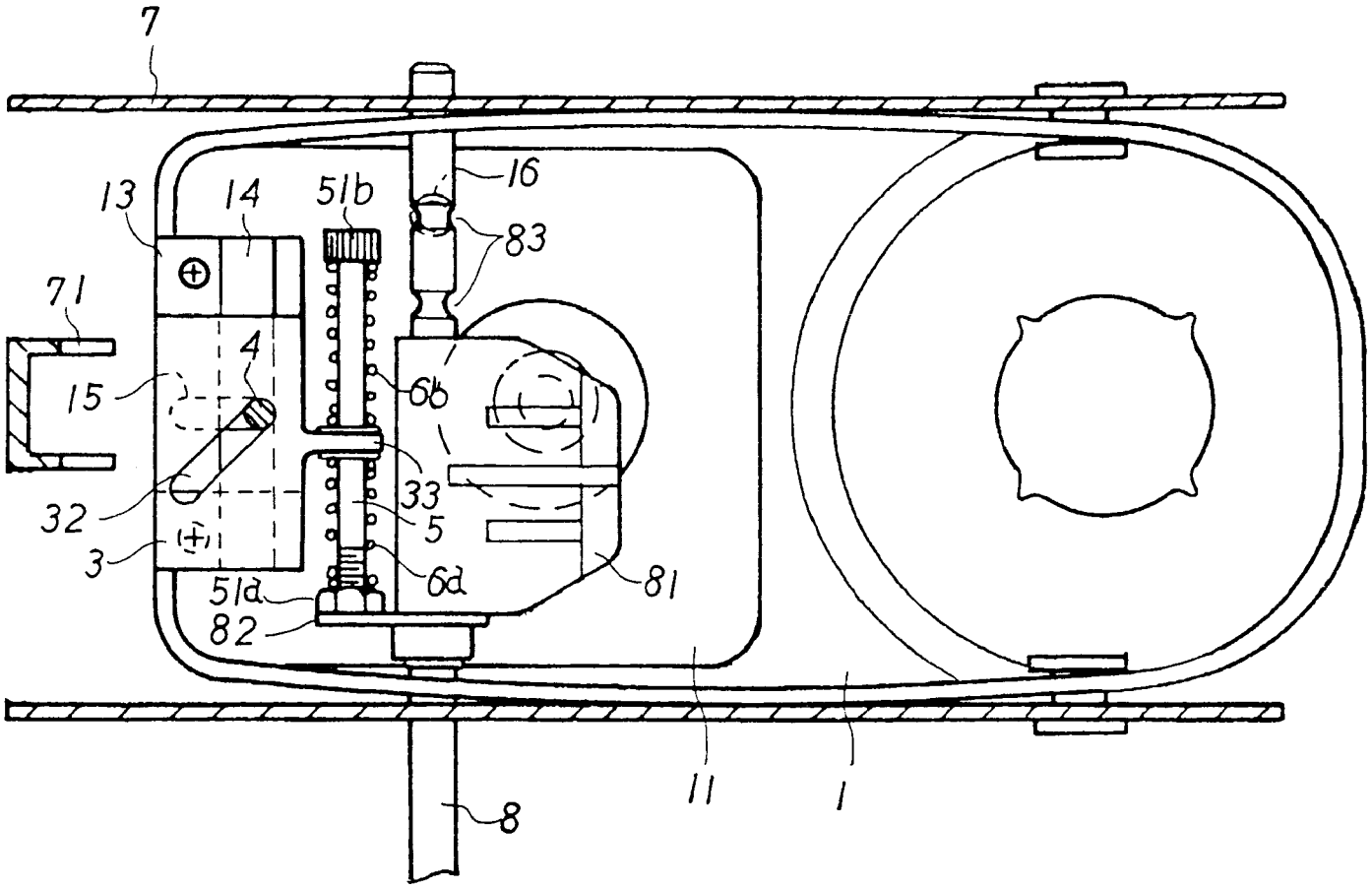
FIG. 2 is a schematic view illustrating an operation of a backrest adjustment device of a preferred embodiment in accordance with the present invention.
Figure 3:
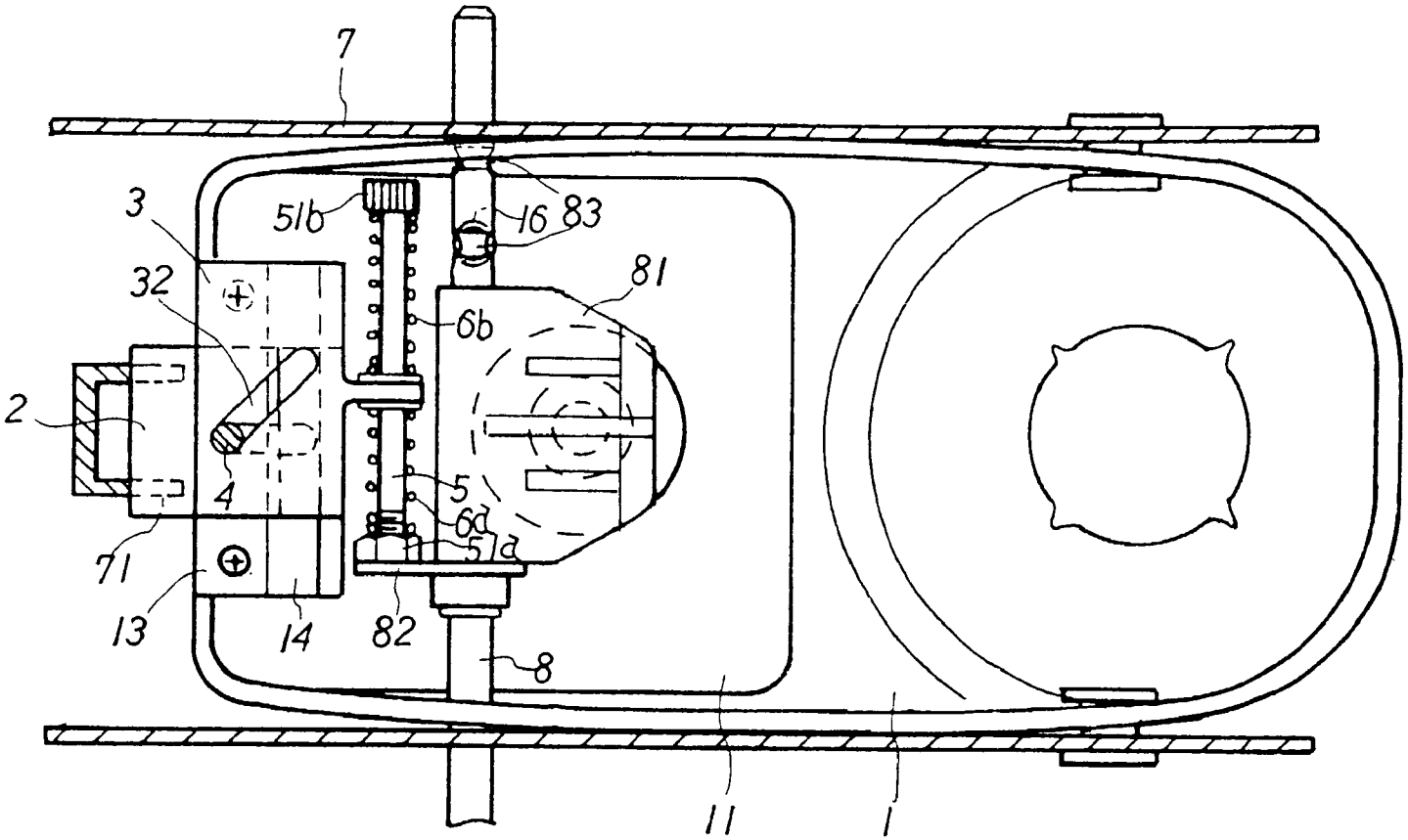
FIG. 3 is a schematic view illustrating another operation of a backrest adjustment device of a preferred embodiment in accordance with the present invention.
Figure 5:
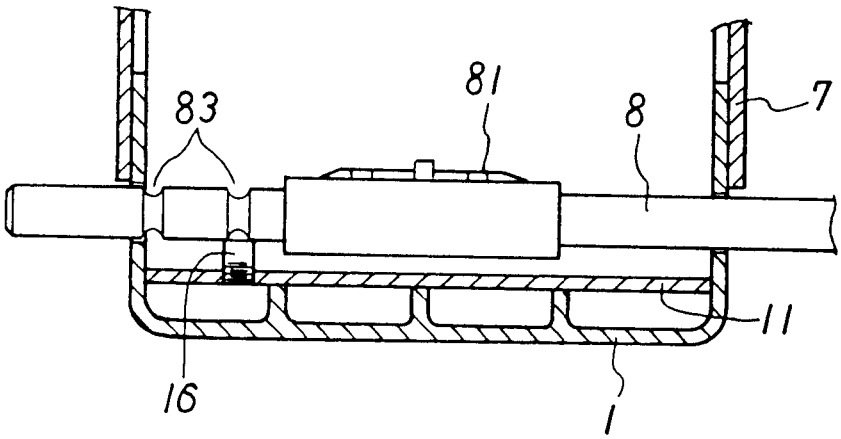
FIG. 5 is a schematic view illustrating another operation of a control rod of a preferred embodiment in accordance with the present invention.
Figure 4:
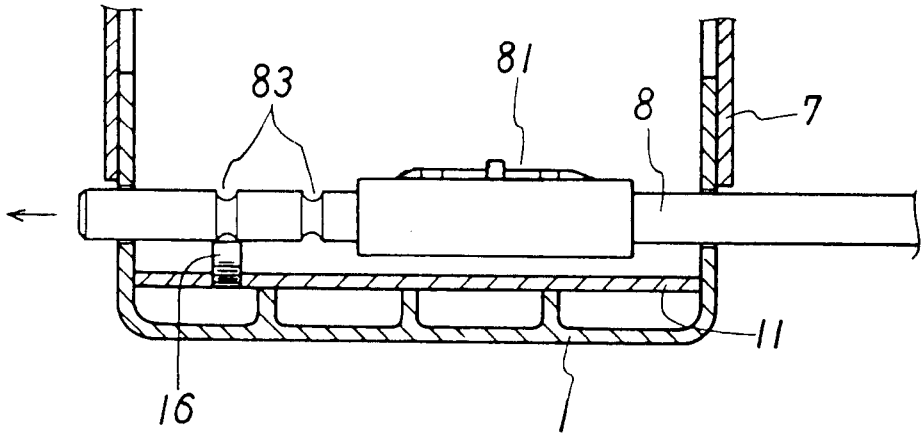
FIG. 4 is a schematic view illustrating an operation of a control rod of a preferred embodiment in accordance with the present invention.
Figure 6:
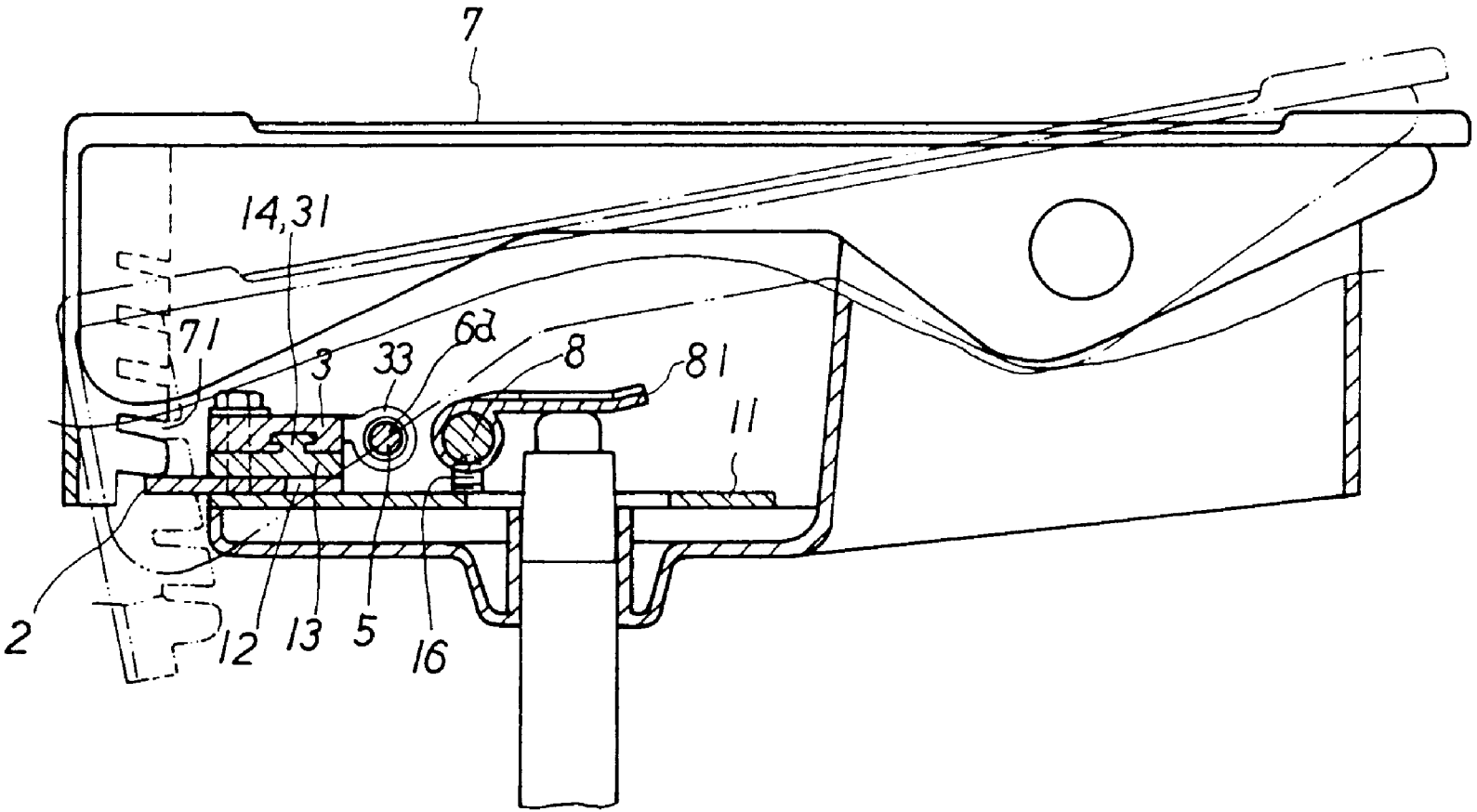
FIG. 6 is a sectional assembly view of a backrest adjustment device of a preferred embodiment in accordance with the present invention.

Referring to FIGS. 1 to 6, a backrest adjustment device comprises a hollow base seat 1, an oblong panel 11, a guide mount 13, a slide seat 3, a nut 51*a*, a coiled spring 6*a*, a compression spring 6*b*, a positioning plate 2, a top panel 7, a screw rod 5, and a control rod 8.

The positioning plate 2 has a threaded aperture 21.

The oblong panel 11 has a threaded hole 111.

The guide mount 13 is disposed on the oblong panel 11.

The guide mount 13 has a bottom recess 12 and an oblong hole 15.

An elastic bead 16 is inserted through the threaded hole 111 of the oblong panel 11.

The positioning plate 2 is inserted in the bottom recess 12 of the oblong panel 11.

The slide seat 3 has a bottom groove 31, a slant slot 32, and a lateral lug 33.

The screw rod 5 has a disk head 51*b*.

The top panel 7 has a plurality of click serrations 71. The top panel 7 engages with the hollow base seat 1.

The control rod 8 has an oval plate 82, an extension bar 81, and a plurality of annular grooves 83.

The screw rod 5 passes through the compression spring 6*b*, the lateral lug 33, the coiled spring 6*a*, the nut 51*a*, and the oval plate 82.

The extension bar 81 is disposed between the top panel 7 and the hollow base seat 1.

The elastic bead 16 is inserted in one of the annular grooves 83 of the control rod 8.

A screw 4 passes through the slot 32 of the slide seat 3, the oblong hole 15 of the guide mount 13, and the threaded aperture 21 of the positioning plate 2.

A slide rack 14 is disposed on the guide mount 13.

The slide rack 14 is inserted in the bottom groove 31 of the slide seat 3.

Referring to FIGS. 2 and 4 again, the positioning plate 2 is inserted in the bottom recess 12 of the oblong panel 11.

Referring to FIGS. 3, 5, and 6 again, the control rod 8 is pushed toward the screw rod 5. The screw rod 5 is driven by the control rod 8. The positioning plate 2 engages with the click serrations 71 of the top panel 7.

The invention is not limited to the above embodiment but various modification thereof may be made. Further, various changes in form and detail may be made without departing from the scope of the invention.

I claim:

1. A backrest adjustment device comprises:

a hollow base seat, an oblong panel, a guide mount, a slide seat, a nut, a coiled spring, a compression spring, a positioning plate, a top panel, a screw rod, and a control rod, the positioning plate having a threaded aperture, the oblong panel having a threaded hole, the guide mount disposed on the oblong panel, the guide mount having a bottom recess and an oblong hole, the positioning plate inserted in the bottom recess of the oblong panel, the slide seat having a bottom groove, a slant slot, and a lateral lug, the screw rod having a disk head, the top panel having a plurality of click serrations, the top panel engaging with the hollow base seat, the control rod having an oval plate, an extension bar, and a plurality of annular grooves, The screw rod passing through the compression spring, the lateral lug, the coiled spring, the nut, and the oval plate, the extension bar disposed between the top panel and the hollow base seat, and a screw passing through the slot of the slide seat, the oblong hole of the guide mount, and the threaded aperture of the positioning plate.

2. The backrest adjustment device as claimed in claim 1, wherein a slide rack is disposed on the guide mount and the slide rack is inserted in the bottom groove of the slide seat.

3. The backrest adjustment device as claimed in claim 1, wherein an elastic bead is inserted through the threaded hole of the oblong panel and the elastic bead is inserted in one of the annular grooves of the control rod.

* * * * *